United States Patent [19]

Klubitschko

[11] Patent Number: 4,535,718

[45] Date of Patent: Aug. 20, 1985

[54] INDICATOR FOR SAFETY SKI BINDING

[75] Inventor: Gerd Klubitschko, Oberau, Fed. Rep. of Germany

[73] Assignee: Marker International Company, Salt Lake City, Utah

[21] Appl. No.: 465,111

[22] Filed: Feb. 9, 1983

[30] Foreign Application Priority Data

Feb. 10, 1982 [DE] Fed. Rep. of Germany ..... 3204649

[51] Int. Cl.[3] ..... G01L 5/03

[52] U.S. Cl. ..... 116/212; 116/DIG. 11; 280/634

[58] Field of Search ..... 116/212, DIG. 11; 280/634, 631, 632, 630; 73/316, 318

[56] References Cited

U.S. PATENT DOCUMENTS 1,456,743 5/1923 Szabo ..... 73/316
1,707,970 4/1929 Watt ..... 73/318
1,777,415 10/1930 Morgan ..... 73/316
3,408,087 10/1968 Ramillon ..... 280/631
3,489,122 1/1970 Schweizer ..... 280/634

FOREIGN PATENT DOCUMENTS 993931 6/1965 United Kingdom ..... 116/DIG. 11

*Primary Examiner*—Charles Frankfort
*Attorney, Agent, or Firm*—Woodling, Krost, Rust & Hochberg

[57] ABSTRACT

An indicator in a grasping piece of a safety ski binding for indicating the setting of an adjustable operating characteristic of the grasping piece, including a window in a part of the grasping piece, a sliding indicator visible through the window and a flexible connection connected at one end to the operating characteristic adjusting means and at the opposite end to the sliding indicator to move the sliding indicator in response to adjustment of the operating characteristic.

2 Claims, 1 Drawing Figure

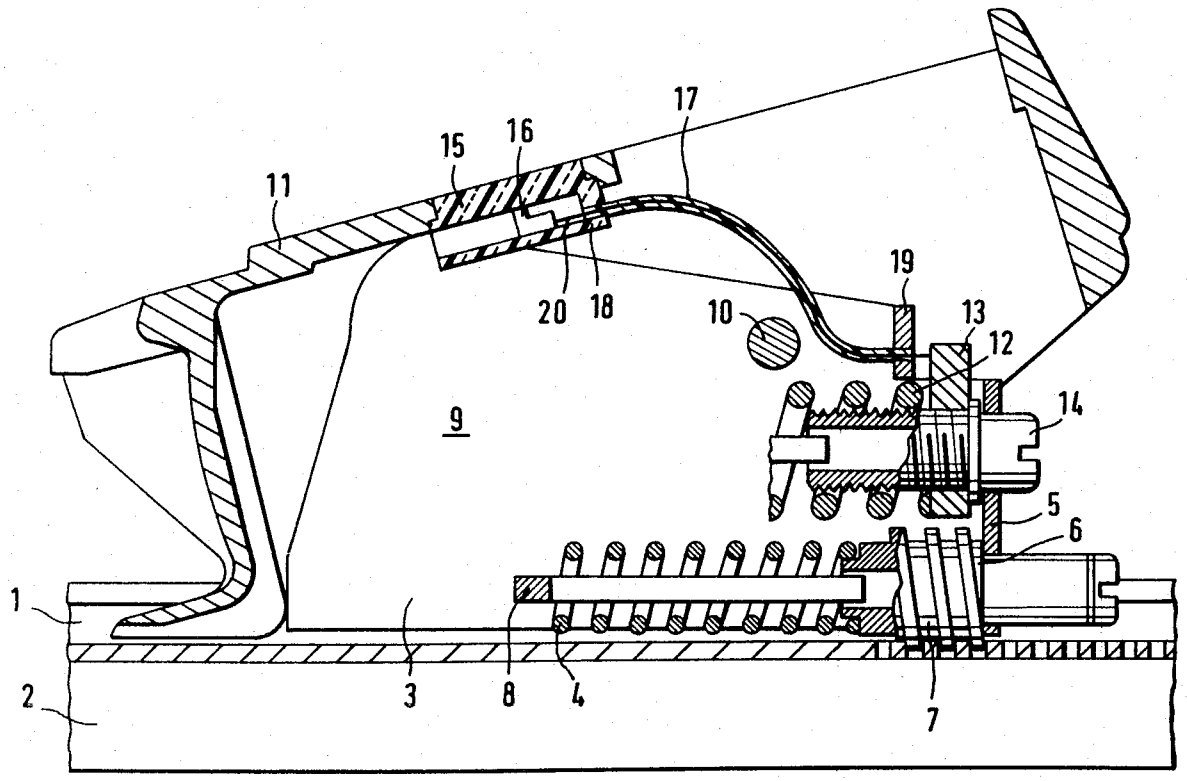
1
2
3
4
5
6
7
8
9
10
11
12
13
14
15
16
17
18
19
20

INDICATOR FOR SAFETY SKI BINDING

BACKGROUND OF THE INVENTION

The present invention relates to safety ski bindings including an indicator for displaying the setting of an adjustable operating characteristic such as release force. The assignee of this application is also the assignee of a related application, Ser. No. 453,919 filed Dec. 28, 1982 for Indicator For Safety Ski Binding.

Known safety ski bindings include at least one grasping piece such as a heel piece or toe piece for grasping a portion of a ski boot. Each grasping piece includes a stationary part fixed to a ski and a pivoting part connected by an axle to the stationary part. Some of these heel and toe pieces include an indicator, visible through a window in the pivoting part and having an adjacent scale, to indicate the setting of an adjustable operating characteristic, such as release force, for the heel or toe piece. Generally, the setting is adjustable by the turning of a screw which engages and compresses or releases the compression of a spring. Turning the screw also causes movement of the indicator relative to the scale. In these known heel and toe pieces, the indicator is fixed to the stationary part and can be accurately read only when the heel or toe piece is latched. These known indicators must also be adjusted to compensate for a change from one ski boot to another having a different sole thickness. Moreover, the indicator can only be read when the binding is latched.

It is desirable to provide an indicator which remains in the window adjacent to the scale in the heel or toe piece, which does not require adjustment to accomodate different ski boot sole thicknesses and which may be read even when the binding is released.

SUMMARY OF THE INVENTION

In the present invention an indicator indicating the setting of an adjustable operating characteristic means is provided in the toe or heel piece of a safety ski binding. The indicator remains in the window and does not require a ski boot thickness compensation adjustment. The indicator includes a sliding indicating means disposed beneath and visible through the window. A movable and flexible interconnection between the sliding indicating means and the adjusting means drives the sliding indicating means in response to adjustment of the adjusting means. Embodiments of the interconnection include a cable, which may be protected within a flexible sheath. The interconnection may be a tube containing a fluid and having pistons at its opposing ends connected to the sliding indicating means and the adjusting means, respectively. The flexibility of the interconnection permits the indicator to be read when the grasping piece is latched and released since the flexing isolates the indicator from the relative movement of the parts of the toe or heel piece.

BRIEF DESCRIPTION OF THE DRAWING

The drawing is a cross sectional side view of a heel piece including an embodiment of the invention.

DETAILED DESCRIPTION OF PREFERRED EMBODIMENT

The FIGURE shows an embodiment of the invention included in a heel piece for grasping the heel portion of a ski boot. An analogous installation of the inventive indicator may be made in a toe piece of a ski binding for grasping the toe portion of a ski boot.

In the drawing a sectional side view of a heel piece for a safety ski binding is shown. The heel piece is intended to grasp the heel portion of a sole of a ski boot and hold it in place so long as the binding is in its latching position. When the skiing forces transmitted by the ski boot to the heel piece exceed a release force threshold, the heel piece switches to its releasing position, releasing its grip on the ski boot.

The depicted heel piece includes a base plate 1 for attachment of the heel piece to a ski 2 by conventional means, such as screws. A stationary part of the heel piece having a pair of opposing side walls, including side wall 9 visible in the figure, is mounted on base plate 1 and includes a movable carriage 3. A helical spring 4 drives carriage 3 by virtue of an attachment 8 between carriage 3 and a shaft mounted within spring 4. One end of spring 4 bears on attachment 8. The end of the shaft opposite attachment 8 is disposed within a threaded barrel 7. The threads of barrel 7 engage complementary screw threads in base plate 1. At the end of spring 4 opposite that joined to attachment 8, spring 4 bears on barrel 7. A shoulder 6 on barrel 7 bears on a back wall 5 of the stationary part. A slotted head extends from barrel 7 beyond back wall 5. Turning the slotted head with a screwdriver adjusts the compression of spring 4 and the position of the heel piece on base plate 1 and on ski 2. Thereby the pressure applied by the heel piece to a ski boot inserted into the binding may be varied. Side wall 9 includes a transverse axle 10 fixed to and through which a pivoting part of the heel piece, including an upper wall 11, is pivotally attached to the stationary part of the heel piece. Axle 10 is designated as transverse because it lies across the width of ski 2 rather than along its length.

The force release threshold is adjusted in a conventional manner, which is therefore not explained here in detail, through a helical spring 12 surrounding a threaded shaft. A threaded nut 13, which is mounted between the opposing side walls to prevent its rotation relative to the threaded shaft, engages the shaft to increase or release the compression of spring 12 as head 14 is turned, preferably with a screwdriver.

A transparent window 15 is mounted in upper wall 11 of the pivoting part of the heel piece and includes a sliding indicator 16 disposed on the inside of a visible through window 15. Indicator 16 is slidably retained and supported beneath and adjacent to window 15 by a retainer 18. A hollow, flexible sheath or tube 17 is connected to window 15 and retainer 18 so that it opens into the chamber formed between the window and retainer. The opposite end of sheath 17 is connected to a flange 19 spanning the side walls, of which side wall 9 is shown. The interior of the sheath is aligned with a hole in flange 19 to permit access to the core of sheath 17. A flexible cable 20 is attached at one end to sliding indicator 16 and passes through sheath 17 and the hole in flange 19 to connect with nut 13.

When head 14 is turned, nut 13 moves longitudinally, i.e. along the length of ski 2. It either pulls or pushes on cable 20 so that sliding indicator 16 is moved in response. Cable 20 has sufficient stiffness so that it may be pushed or pulled without binding or kinking. The cable therefore transmits both pushing and pulling forces. A known assembly functioning in this manner is sometimes referred to as a Bowden cable or wire. In the manner described, the indicator changes positions to display the setting of the adjusted value, in this case the force release threshold. Preferably, a scale is fixed directly against window 15 for reading the relative position of sliding indicator 16.

Because the connection of the sliding indicator and adjusting means is maintained even when the heel piece is released, the indicator may be read accurately whether the heel piece is latched or released. To achieve this end, it is important that the indicator be designed so that there is no net change of stress on cable 20 between the latched and released positions of the grasping piece.

In another embodiment of the indicator the flexible sheath may be filled with a liquid sealed within the sheath by sliding pistons. One of the pistons is connected to nut 13 and the other to sliding indicator 16. As nut 13 is adjusted in position, indicator 16 is hydraulically driven by the moving liquid in response. Again, because of the flexibility of the connection, the indicator may be read regardless of whether the grasping piece is latched or released.

In the embodiments described, the indicator adds no significant additional force to that normally required to latch the grasping piece. Since the sliding indicator remains in position throughout the elastic range of the latched grasping piece (and even during when the grasping piece is released), there is no need to provide an indicator adjustment to accomodate varying ski boot sole thicknesses.

The invention has been described with reference to certain preferred embodiments. Those of skill in the art will recognize various substitutions, additions and modifications without departing from the spirit of the invention. Accordingly, the scope of the invention is limited solely by the following claims.

I claim:

1. An indicator in a safety ski binding, said binding including at least one grasping piece having latching and releasing positions for latching and releasing a portion of a ski boot, respectively, said grasping piece comprising:

a stationary part fixable to a ski;

a pivoting part pivotally connected to said stationary part along a transverse axle for engaging a ski boot;

a spring for establishing a force release threshold for said pivoting part;

mounting means fixed in said stationary part and an adjusting nut mounted for movement on said mounting means relative to said stationary part for changing the compression of said spring to vary said force release threshold;

window means in said pivoting part for viewing an indicating means;

sliding indicating means disposed in said pivoting part and visible through said window means for indicating the setting of said adjusting nut;

flexible indicator connecting means including first and second ends for movably interconnecting said sliding indicating means and said adjusting nut, said first end being connected to said adjusting nut and said second end being connected to said sliding indicating means for movement of said sliding indicating means by said adjusting nut when said adjusting nut moves on said mounting means and said connecting means comprising a flexible cable and a flexible sheath through which said cable passes.

2. The invention according to claim 1, further including retaining means depending from said pivoting part for supporting and retaining said sliding indicating means slidably adjacent said window means.

* * * * *